United States Patent [19]

Gerlach

[11] 4,347,894

[45] Sep. 7, 1982

[54] HEAT EXCHANGER

[76] Inventor: Jürgen Gerlach, c/o Gerlach GmbH Maschinebau, In den Gärten 5, 5140 Erkelenz, Fed. Rep. of Germany

[21] Appl. No.: 183,726

[22] Filed: Sep. 3, 1980

[30] Foreign Application Priority Data

Sep. 4, 1979 [DE] Fed. Rep. of Germany ..... 2935626

[51] Int. Cl.[3] ..... F28F 9/22; F28D 7/02

[52] U.S. Cl. ..... 165/76; 165/163; 165/169; 165/178

[58] Field of Search ..... 165/154, 156, 163, 169, 165/165, 76, 178

[56] References Cited

U.S. PATENT DOCUMENTS

| | | | |
|---|---|---|---|
| 757,846 | 4/1904 | Simpson | 165/163 |
| 1,132,757 | 3/1915 | Ashton | 165/163 |
| 2,012,216 | 8/1935 | Baumann | 165/163 X |
| 2,146,141 | 2/1939 | Harris | 165/163 X |
| 2,797,069 | 6/1957 | Layton | 165/163 |
| 2,932,490 | 4/1960 | Olander | 165/163 |
| 3,138,201 | 6/1964 | Huet | 165/163 |
| 3,871,444 | 3/1975 | Houser et al. | 165/163 X |
| 4,061,184 | 12/1977 | Radcliffe | 165/156 X |
| 4,202,406 | 5/1980 | Avery | 165/163 X |
| 4,231,425 | 11/1980 | Engstrom | 165/156 |
| 4,280,556 | 7/1981 | Cooper | 165/76 |

FOREIGN PATENT DOCUMENTS

| | | | |
|---|---|---|---|
| 468323 | 9/1950 | Canada | 165/163 |
| 4056 | of 1873 | United Kingdom | 165/163 |
| 10358 | of 1904 | United Kingdom | 165/163 |
| 962837 | 7/1964 | United Kingdom | 165/164 |

*Primary Examiner*—Sheldon J. Richter
*Attorney, Agent, or Firm*—Thomas J. Greer, Jr.

[57] ABSTRACT

A heat exchanger having an openable casing for the removable reception of a fluid carrying coil for a first fluid. The coil includes a straight section surrounded by helical turns. The helical turns contacting the interior surface of the casing to thereby form a complimentary helical fluid flow path for a second fluid. The casing is provided with an inlet and an outlet for the second fluid, the first fluid entering one end of the coil and exiting from the other end of the coil.

4 Claims, 3 Drawing Figures

FIG.1
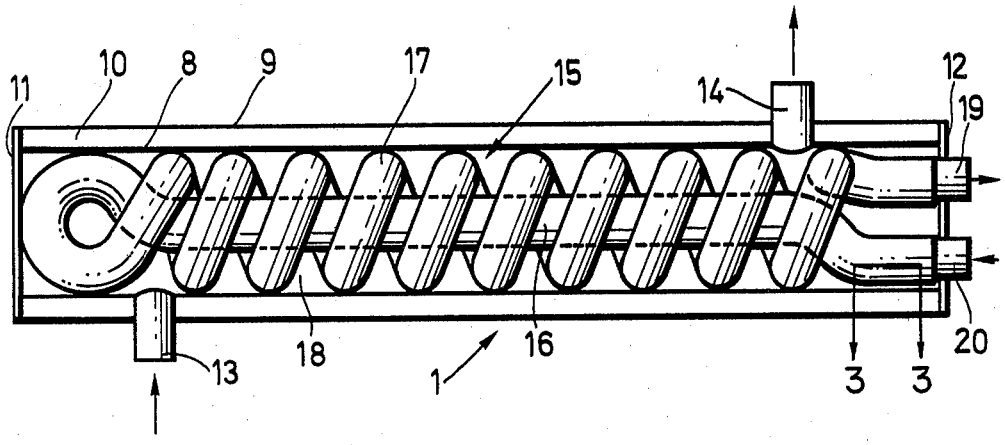
FIG. 2
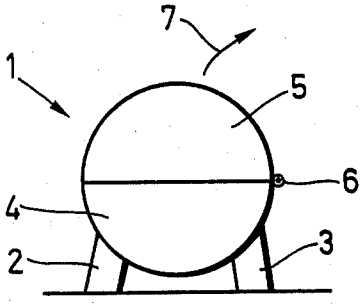
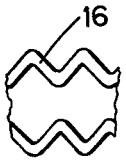
FIG. 3

HEAT EXCHANGER

The invention concerns a heat exchanger with a casing and a piping arranged in same for the separate flow of media having different temperatures. This heat exchanger is especially intended for the exchange of heat between aerosol-containing hot exhaust air and fresh air.

All kinds of designs of heat exchangers are known. Generally speaking, they all contain a more or less straight piping passing through a casing for the one medium over the outside of which the other medium passes which flows through the casing. The heat exchange is effected through the wall of the piping. Efforts are being made in this instance to have the medium to be cooled flow as slowly as possible in order to guarantee as long a contact as possible with the wall of the piping while the cold medium is to flow quickly in order to immediately remove the heat transmitted to the wall of the piping. However, as long a contact as possible of the medium to be cooled with the piping has not only the advantage that as large a portion as possible of the heat contained in this medium is transmitted to the piping but also the disadvantage that carried-along impurities, such as vapor or aerosol particles, settle on the piping and form, in the course of time, a crust on the piping impairing the heat transfer. Therefore, the possibility of energy recovery is limited in the case of known heat exchangers.

It is the task of the invention to create a heat exchanger which, on the one hand, is in a position of recovering a large heat proportion from the flowing medium and, on the other hand, of separating impurities, such as aerosols, carried along by this flowing medium.

This task is accomplished with a heat exchanger according to the invention of the kind as mentioned in the introduction by the fact that the casing is a tube with an inlet and an outlet for a flowing medium which are located close to the one or to the other end of the tube and that the piping is a coil having a helical design which is arranged so as to rest against the inner wall of the casing with its outer circumference and so as to be exchangeable. The coil having a helical design and resting with its outer circumference against the inner wall of the casing effects a forced flow of the hot exhaust air passing through the casing on as long a path as possible through the heat exchanger and thus an extremely long contact with the piping so that a large portion of the residual heat contained in the exhaust air can be recovered. On the other hand, foreign particles, such as aerosols, carried along by the exhaust air condense and are thus separated from the exhaust air owing to the large surface of the piping carrying fresh air over which the exhaust air passes and to the high heat removal on the surface of the piping. As soon as a certain amount of condensate has accumulated on the coil which can noticeably impair the heat transfer through the piping, the coil is replaced by another coil which can be done within a very short period of time without a noticeable interruption of the operation of the heat exchanger whereupon the replaced coil can be cleaned at ease outside the heat exchanger and can be prepared again for use in the heat exchanger.

The heat exchanger can practically operate without interruption with two interchangeable coils.

In accordance with a practical design of the invention, the coil consists of a grooved metal ring hose which has a larger surface than a smooth pipe and thus results in an optimum surface of the coil which, on the one hand, takes care of a good heat transfer and, on the other hand, supports the condensing of impurities, such as aerosols, carried along in the exhaust air.

In accordance with a preferred practical design of the invention, the coil is designed as a cartridge-like insert the ends of which end at one of the front parts of the casing. This insert can be quickly dismounted and mounted and can also be easily handled outside the heat exchanger for cleaning purposes and for its preparation for renewed use.

In this instance, it is expedient to provide each of the two ends of the coil with a detachable plug connection so that it can be removed quickly and without any problems from the fresh air piping or again attached to it.

A particularly advantageous design of the coil provides that it has a straight central section and a section running back around it in a helical manner whereby the helical section of the coil is wound around the straight section and is in contact with it. The grooved metal ring hose forming the coil has appropriately a diameter which amounts to about a third of the outer diameter of the coil or to a third of the inner diameter of the tube-shaped casing. The straight central section of the coil and the casing in which it is inserted form, therefore, a helical-like channel in the casing together with the helical-like section of the coil through which the hot exhaust air must flow when passing through the heat exchanger. Therefore, the flow path of the exhaust air through the heat exchanger amounts to a multiple of the length of the heat exchanger casing so that a high heat transfer is obtained within a smallest possible space with a simultaneous optimum separation of impurities, such as aerosols.

In order to be able to perform the exchange of the coil particularly quickly, the tube-shaped casing is horizontally separated, approximately at its center, in accordance with an additional feature of the invention whereby the upper part is designed so that it can be swung away. In order to replace a coil, the case is swung open, the plug connections of the coil to the fresh air piping are taken out, the coil designed as a cartridge-like insert is removed from the open casing, the same type of clean coil is placed into the casing, the coil is connected to the fresh air piping with the help of the plug connections and the casing is closed. This exchange process can be effected within a very short period of time, for example, within one minute. Therefore, a noticeable interruption of the operation of the heat exchanger is not necessary.

Preferably, the tube-shaped casing is provided with a heat insulation jacket in order to avoid a heat radiation towards the outside and a condensation of aerosols or other impurities of the exhaust air on the casing wall. Heat is practically only removed from the hot air through the coil so that aerosols or other impurities settle only on the coil due to condensation.

A novel heat exchanger is created by the invention which is in a position of complying with such contrasting requirements as a good energy recovery and a separation of foreign particles from the exhaust air in an optimum manner by means of condensation.

An exemplified embodiment of the heat exchanger according to the invention is schematically represented in the drawing. There are shown:

FIG. 1 a top view on the heat exchanger with an installed coil whereby the upper part of the casing has been eliminated and FIG. 2 a front view of the heat exchanger of FIG. 1 with a closed casing.

FIG. 3 is a view taken along section 3—3 of FIG. 1 showing the longitudinal cross-sectional shape of the grooved metal ring hose which forms the coil.

The heat exchanger has a tube-like designed casing 1 which consists of a stationary lower part 4 resting on legs 2 and 3 and an upper part 5 which is connected with the lower part 4 by means of hinges 6 and can be swung open in the direction of an arrow 7 shown in FIG. 2 so that the lower part 4 is freely available. Locking devices which are not shown can hold the two parts 4 and 5 of the casing 1 together in the closed position as shown in FIG. 2 in order to avoid the escape of exhaust air flowing through the casing 1 during the operation of the heat exchanger.

The lower part 4 as well as the upper part 5 of the casing 1 consist of two walls 8 and 9 arranged concentrically towards each other between which there is a heat insulation filling 10. Also the front walls 11 and 12 are designed with double walls with heat insulation filling.

The casing 1 is provided with a socket 13 close to one end for the supply of hot exhaust air and with a socket 14 close to its other end for the discharge of the cooled exhaust air. These two sockets 13 and 14 can be arranged on the lower part 4 as well as on the upper part 5 and they are not shown in FIG. 2.

A coil 15 is in the casing 1 which is formed by a grooved metal ring hose and has a straight central section 16 around which an outer section 17 is wound in a helical manner in such a way that it touches the straight section 16 and thus the center of the helical-like section 17 is occupied by the straight section 16. The individual windings of the helical-like section 17 rest on the inner wall 8 of the casing 1 so that the coil 15 occupies the interior of the tube-shaped or circular casing 1 and the hot air being supplied through the socket 13 must flow in a forced manner between the individual helices of the helical-like section 17 through a helical-like channel 18, which has formed there, to the socket 14.

Connecting sockets 19 and 20 are provided in the front wall 12 for a fresh air piping which is not shown whereby the coil 15 is to be connected with these connecting sockets 19 and 20 through detachable plug connections. In this way, the coil 15 designed as a cartridge-like insert can be easily dismounted as a complete unit and replaced by a clean coil of the same type.

The grooved metal ring hose forming the coil 15 has a particularly large surface. In the case of the shown exemplified embodiment, its largest outer diameter amounts to one third of the inner diameter of the inner casing wall 8 so that the coil 15 completely occupies the casing and the straight section 16 of the coil forms the core of the helical-like section 17. Accordingly, the hot and, for example, aerosol-containing exhaust air flowing through the casing 1 must flow through the helical-shaped comparatively long channel 18. At the same time, fresh air having room temperature is introduced into the coil 15 through the socket 20 which also covers a long way on its return path through the helical-like section 17 until it leaves the coil again through the connecting socket 19. When passing through the coil 15, it removes heat from the exhaust air flowing over the coil 15. At the same time, impurities, such as aerosols, contained in the exhaust air condense on the very large surface of the coil 15. When a certain amount of aerosol has settled on the coil 15, the casing 1 is swung open over its entire length and the coil 15 also practically occupying the casing 1 over its entire length is removed after having been detached from the connecting sockets 19 and 20 and it is replaced by a clean coil 15 of the same type. The casing 1 is closed again so that the heat exchanger can continue its normal operation already after a very short period of time, for example, after one minute. The removed coil 15 can now be easily cleaned independently of the operation of the heat exchanger.

In this way, on the one hand, a good energy recovery is achieved from the hot exhaust air and, furthermore, the separation of aerosols and such.

In the case of a practical design of the invention, the inner diameter of the casing amounts to 500 mm and its length to 3000 mm. The coil 15, installed in a casing 1 with such dimensions, has a surface of almost 15 $m^2$ which is available for the heat exchange, i.e. an extremely large heat exchange surface.

I claim:

1. A heat exchanger having a casing (1) and a piping (15) arranged in the casing for the separate flow and heat exchange of media having different temperatures, the casing (1) having an inlet (13) and an outlet (14) for a flowing medium and the piping being a coil (15) having a helical form which is arranged so that a portion of its outer surface rests against the inner wall (8) of the casing, the improvement comprising, the coil (15) having a straight central section (16) and a section running back around it (17) in a helical manner, whereby a helical channel (18) for the passage of a heat exchange medium fed into the inlet (13) and passing out from the outlet (14) is defined by the piping (17) resting against the inner wall (8) and the straight central section (16), thereby increasing the area of heat transfer and also increasing the area on which impurities may condense, the inlet (13) and the outlet (14) each communicating with the helical channel (18), the casing (1) being formed of two horizontally separated sections (4, 5), the upper section (5) being swung away, when desired, to thereby permit the piping coil (15) to be removed from the casing for cleaning, the said coil (15) being formed as a cartridge-like insert both ends of which terminate at one end portion (12) of the casing (1).

2. The heat exchanger of claim 1 wherein the piping consists of grooved metal ring hose.

3. The heat exchanger of claim 1 wherein the casing (1) has a heat insulating jacket (8, 9, 10).

4. The heat exchanger of claim 1 wherein the two ends of the coil (15) are each provided with a detachable plug connection (19, 20).

* * * * *